US011708239B2

(12) United States Patent
Larmuseau et al.

(10) Patent No.: US 11,708,239 B2
(45) Date of Patent: Jul. 25, 2023

(54) SEAMLESS TRACKING OF PASSENGER FLOW WITHIN AN ELEVATOR CABIN

(71) Applicant: Otis Elevator Company, Farmington, CT (US)

(72) Inventors: Adriaan Joris H. Larmuseau, Shanghai (CN); Changle Li, Shanghai (CN)

(73) Assignee: OTIS ELEVATOR COMPANY, Farmington, CT (US)

( * ) Notice: Subject to any disclaimer, the term of this patent is extended or adjusted under 35 U.S.C. 154(b) by 1376 days.

(21) Appl. No.: 16/039,972

(22) Filed: Jul. 19, 2018

(65) Prior Publication Data

US 2019/0023527 A1 Jan. 24, 2019

(30) Foreign Application Priority Data

Jul. 20, 2017 (CN) ..... 201710594962.8

(51) Int. Cl.
*B66B 1/34* (2006.01)
*B66B 1/46* (2006.01)

(52) U.S. Cl.
CPC ..... *B66B 1/468* (2013.01); *B66B 1/3461* (2013.01); *B66B 1/3476* (2013.01); *B66B 2201/4615* (2013.01); *B66B 2201/4638* (2013.01); *B66B 2201/4653* (2013.01)

(58) Field of Classification Search
CPC ..... B66B 1/3446–3461; B66B 1/468
See application file for complete search history.

(56) References Cited

U.S. PATENT DOCUMENTS

| | | | |
|---|---|---|---|
| 4,685,538 | A | 8/1987 | Kamaike |
| 4,979,594 | A | 12/1990 | Begle et al. |
| 5,952,626 | A | 9/1999 | Zaharia |
| 5,984,051 | A | 11/1999 | Morgan et al. |
| 6,109,396 | A | 8/2000 | Sirag et al. |
| 6,202,799 | B1 | 3/2001 | Drop |
| 6,209,685 | B1 | 4/2001 | Zaharia et al. |

(Continued)

FOREIGN PATENT DOCUMENTS

| | | | |
|---|---|---|---|
| CN | 101920896 | A | 12/2010 |
| CN | 202717457 | U | 2/2013 |

(Continued)

OTHER PUBLICATIONS

Machado, Carlos, "Bluetooth Beacons for Tracking", Accuware Inc., Jan. 30, 2017, 3 pages.

(Continued)

*Primary Examiner* — Christopher Uhlir
(74) *Attorney, Agent, or Firm* — Cantor Colburn LLP

(57) ABSTRACT

The present invention relates to tracking of a passenger flow in an elevator car. A passenger flow tracking system for an elevator car according to the present invention includes: a first Bluetooth module installed in the elevator car, the first Bluetooth module being configured to broadcast a first Bluetooth signal that can substantially cover the interior of the elevator car and receive a response fed back by a personal mobile terminal carried by a passenger inside the elevator car; and a passenger flow determining unit configured to at least determine, based on a change in the received response, that the passenger leaves and/or enters the elevator car.

27 Claims, 3 Drawing Sheets

(56) References Cited

U.S. PATENT DOCUMENTS

| | | | | |
|---|---|---|---|---|
| 6,257,373 | B1 | 7/2001 | Hikita et al. | |
| 6,382,363 | B1 | 5/2002 | Friedli | |
| 6,397,976 | B1 | 6/2002 | Hale et al. | |
| 7,377,364 | B2 | 5/2008 | Tyni et al. | |
| 7,426,981 | B2 | 9/2008 | Bacellar et al. | |
| 7,552,800 | B2 | 6/2009 | Puskala et al. | |
| 7,737,861 | B2 | 6/2010 | Lea et al. | |
| 9,063,212 | B2 | 6/2015 | Jones, Jr. | |
| 9,380,425 | B2 * | 6/2016 | Meredith | H04L 67/535 |
| 10,757,654 | B2 * | 8/2020 | Wang | H01Q 21/00 |
| 2008/0011557 | A1 | 1/2008 | Hakala et al. | |
| 2010/0315208 | A1 * | 12/2010 | Takeuchi | B66B 1/468 340/286.06 |
| 2016/0277560 | A1 | 9/2016 | Gruberman et al. | |
| 2019/0193992 | A1 * | 6/2019 | Studer | B66B 5/0025 |
| 2019/0375609 | A1 * | 12/2019 | Hosokawa | B66B 1/14 |

FOREIGN PATENT DOCUMENTS

| | | | |
|---|---|---|---|
| CN | 204057529 | U | 12/2014 |
| CN | 105143080 | A | 12/2015 |
| CN | 204873294 | U | 12/2015 |
| CN | 204897058 | U | 12/2015 |
| CN | 105293227 | A | 2/2016 |
| CN | 105502111 | A | 4/2016 |
| CN | 105565091 | A | 5/2016 |
| CN | 105731198 | A | 7/2016 |
| CN | 105829223 | A | 8/2016 |
| CN | 205472059 | U | 8/2016 |
| CN | 106044421 | A | 10/2016 |
| CN | 106144797 | A | 11/2016 |
| CN | 106219336 | A | 12/2016 |
| CN | 205855656 | U | 1/2017 |
| CN | 205873545 | U | 1/2017 |
| CN | 106379788 | A | 2/2017 |
| CN | 106744103 | A | 5/2017 |
| DE | 10005897 | A1 | 8/2001 |
| JP | 2017095213 | A | 6/2017 |
| KR | 20040095552 | A | 11/2004 |
| KR | 20160065262 | A | 6/2016 |
| WO | 2008116963 | A1 | 10/2008 |
| WO | 2014178790 | A1 | 11/2014 |
| WO | 2016073067 | A1 | 5/2016 |
| WO | 2016100293 | A1 | 6/2016 |
| WO | 17050785 | A1 | 3/2017 |

OTHER PUBLICATIONS

European Search Report for application EP 18184748.4, dated Jan. 7, 2019, 16 pages.

Indian Search Report for Application No. 201814027105; dated Dec. 2, 2020; 5 Pages.

Korean Office Action for Application No. 1020180084522; dated Jan. 30, 2023; 14 Pages.

* cited by examiner

SEAMLESS TRACKING OF PASSENGER FLOW WITHIN AN ELEVATOR CABIN

FOREIGN PRIORITY

This application claims priority to Chinese Patent Application No. 201710594962.8, filed Jul. 20, 2017, and all the benefits accruing therefrom under 35 U.S.C. § 119, the contents of which in its entirety are herein incorporated by reference.

TECHNICAL FIELD

The present invention belongs to the field of elevator intelligent control technologies, and relates to a passenger flow tracking system and method that track a passenger flow in an elevator car by using a Bluetooth module installed in the elevator car, an elevator system that uses the passenger flow tracking system, and a control method for the elevator system.

BACKGROUND ART

With the development of elevator technologies, various automatic elevator calling technologies that do not require an input operation of a passenger are springing up. For example, an elevator system can automatically send an elevator calling request command to the elevator system according to an action or a movement of a passenger. However, the uncertainty of the action or movement of the passenger easily causes an invalid elevator calling.

SUMMARY OF THE INVENTION

According to a first aspect of the present invention, a passenger flow tracking system for an elevator car is provided, including: a first Bluetooth module installed in the elevator car, the first Bluetooth module installed being configured to broadcast a first Bluetooth signal that can substantially cover the interior of the elevator car and receive a response fed back by a personal mobile terminal carried by a passenger inside the elevator car; and a passenger flow determining unit configured to determine, based on a change in the received response, that the passenger leaves and/or enters the elevator car.

According to a second aspect of the present invention, a passenger flow tracking method for an elevator car is provided, including steps of: broadcasting, by a first Bluetooth module installed in the elevator car, a first Bluetooth signal that can substantially cover the interior of the elevator car; receiving, by a personal mobile terminal carried by a passenger, the first Bluetooth signal and feeding a response back to the first Bluetooth module; and determining, based on a change in the received response, that the passenger leaves and/or enters the elevator car.

According to a third aspect of the present invention, an elevator system is provided, including one or more elevator cars and an elevator controller configured to control running of the one or more elevator cars, and further including the passenger flow tracking system according to the first aspect of the present invention.

According to a fourth aspect of the present invention, a control method for an elevator system is provided, wherein based on a passenger who leaves the elevator car and corresponds to an elevator landing area as determined by the passenger flow tracking system, an elevator calling request command that is automatically sent by the personal mobile terminal of the passenger as the passenger leaves the elevator car for the elevator landing area is ignored.

The foregoing features and operations of the present invention will become more obvious according to the following description and accompanying drawings.

BRIEF DESCRIPTION OF THE DRAWINGS

In the following detailed description with reference to the accompanying drawings, the foregoing and other objectives and advantages of the present invention will become more complete and clearer, where identical or similar elements are represented by using identical reference numerals.

DETAILED DESCRIPTION

The present invention is now described more thoroughly with reference to the accompanying drawings. The accompanying drawings show exemplary embodiments of the present invention. However, the present invention may be implemented in various different forms and should not be construed as being limited to the embodiments illustrated herein. On the contrary, these embodiments are provided to make the present disclosure thorough and complete and fully convey the idea of the present invention to those skilled in the art.

Some block diagrams shown in the accompanying drawings are functional entities, and do not necessarily correspond to physically or logically independent entities. The functional entities may be implemented in a software form, in one or more hardware modules or integrated circuits, or in different processing apparatuses and/or micro controller apparatuses.

In the present invention, a passenger flow refers to movement of a passenger with respect to an elevator car and can include the following situations: the passenger leaves the elevator car and enters, for example, an elevator landing area when a car door opens; the passenger enters the elevator car from, for example, an elevator landing area when a car door opens; and the passenger stays in the elevator car. It will be understood that if the car door of the elevator car is not open, the passenger flow in the elevator car does not change.

Figure 1:
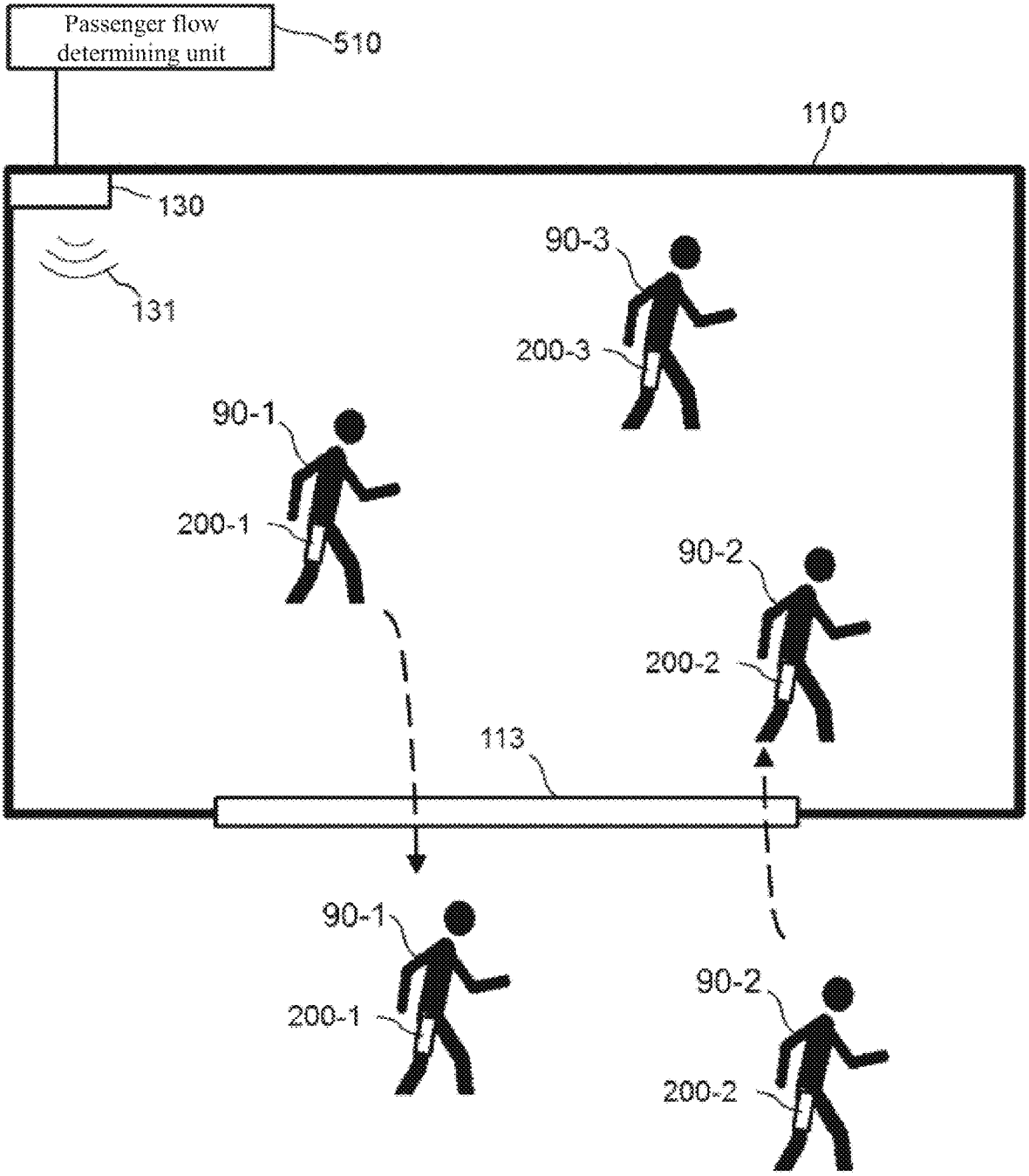
FIG. 1 is a schematic diagram of a passenger flow tracking system for an elevator car according to an embodiment of the present invention.

FIG. 1 is a schematic diagram of a passenger flow tracking system according to an embodiment of the present invention. The passenger flow tracking system is illustrated by using an elevator car 110 in an elevator system. The elevator car 110 can run up and down in a hoistway of a building, thereby carrying a passenger to a corresponding destination floor. It should be understood that the setting of the elevator car 110 can be applied to other elevator cars in the elevator system analogically.

As shown in FIG. 1, the passenger flow tracking system mainly includes a first Bluetooth module 130 installed in an elevator car 110. The first Bluetooth module 130 can broadcast a first Bluetooth signal 131 that can basically cover the interior of the elevator car 110. In an embodiment, the first Bluetooth module 130 can broadcast the first Bluetooth signal 131 continuously in a running process of the elevator car 110. In another embodiment, the first Bluetooth module 130 can broadcast the first Bluetooth signal 131 only when the elevator car 110 stops at a certain floor. The broadcasted first Bluetooth signal 131 can include information of a floor where the elevator car 110 is currently located, for example, floor N.

In an embodiment, the first Bluetooth module 130 can be a Bluetooth beacon or a Bluetooth node, and can be communicatively connected with a controller in the elevator system where the elevator car 110 is located. In an embodiment, the first Bluetooth module 130 in the elevator car 110 can be, but is not limited to, installed on a destination floor registration control panel in the elevator car 110, and integrally disposed on the destination floor registration control panel. As such, the first Bluetooth module 130 can establish a communication connection (not shown in the figure) with the elevator controller of the elevator system. It will be understood that the installation position of the first Bluetooth module 130 in the elevator car 110 is not restrictive.

The first Bluetooth module 130 can interact with a personal mobile terminal 200 carried by a passenger 90 inside the elevator car 110 by using the first Bluetooth signal 131. For example, the first Bluetooth module 130 can receive a response fed back by the personal mobile terminal 200. A Bluetooth communication module can be disposed on the personal mobile terminal 200, so that the personal mobile terminal 200 can receive the first Bluetooth signal 131 when the passenger 90 is inside the elevator car 110. Specifically, a broadcast distance of the first Bluetooth module 130 can be set according the size of the elevator car 110, the installation position of the first Bluetooth module 130, and so on. Therefore, the personal mobile terminal 200 of the passenger 90 who is outside the elevator car 110 basically cannot receive the first Bluetooth signal 131.

When the personal mobile terminal 200 receives the first Bluetooth signal 131, it is indicated that the passenger 90 and the personal mobile terminal 200 thereof are substantially inside the elevator car 110, and the personal mobile terminal 200 is capable of establishing a corresponding Bluetooth connection with the first Bluetooth module 130 and feeding a corresponding response back. In an embodiment, the response fed back by the personal mobile terminal 200 can be universally unique identifier (UUID) passenger identifier information of the passenger corresponding to the personal mobile terminal. The passenger identifier information can be uniformly assigned to all passengers 90 in advance and stored in respective personal mobile terminals 200.

Optionally, the personal mobile terminal 200 can also be provided with a signal strength determining module (such as an RSSI), which can determine, in real time, signal strength of the received first Bluetooth signal 131. The personal mobile terminal 200 can further feed the obtained signal strength back to the first Bluetooth module 130 as the response or partial information of the response. As such, the first Bluetooth module 130 can roughly determine, according to the signal strength, whether the passenger 90 is inside the elevator car or outside the elevator car. Movement of the passenger 90 with respect to the elevator car 110 can be roughly determined based on a change in the signal strength. For example, when the signal strength is greater than a predetermined value at first and then becomes less than the predetermined value, it is determined that the passenger 90 leaves the elevator car 110. When the signal strength is less than the predetermined value at first and then becomes greater than the predetermined value, it is determined that the passenger enters the elevator car 110.

Optionally, the personal mobile terminal 200 can also be provided with a position determining unit, such as a GPS positioning module, which can obtain position information through positioning with respect to the elevator car 110, e.g., being outside the elevator car 110 or inside the elevator car 110. The personal mobile terminal 200 can further feed the obtained position information back to the first Bluetooth module 130 as the response or partial information of the response. As such, the first Bluetooth module 130 can roughly determine, according to a change in the position information, whether the passenger 90 enters the elevator car 110 or leaves the elevator car 110.

Optionally, the personal mobile terminal 200 can also store or generate destination floor information of the passenger, that is, current destination floor information of the passenger. The personal mobile terminal 200 feeds the destination floor information back to the first Bluetooth module 130 as partial information of the response. As such, the first Bluetooth module 130 can determine, with the assistance of the destination floor information, whether the passenger 90 enters the elevator car or leaves the elevator car.

In an embodiment, considering that the personal mobile terminal 200 of a passenger 90 near the elevator car 110 possibly can receive a relatively weak first Bluetooth signal 131, the personal mobile terminal 200 can be configured to feed the response back to the first Bluetooth module 130 only when signal strength of the received first Bluetooth signal 131 is greater than or equal to a predetermined value. The personal mobile terminal 200 can also be provided with a signal strength determining module (such as an RSSI). The signal strength determining module can determine the signal strength of the received first Bluetooth signal 131. The predetermined value can be set according to a specific situation. For example, a value of the signal strength of the first Bluetooth signal 131 received when the passenger 90 is outside and near the car door 113 of the elevator car 110 (the car door 113 is open) is used as the predetermined value.

In an embodiment, the first Bluetooth signal 113 can include a request sent by the first Bluetooth module 130. In other words, the first Bluetooth module 130 can broadcast a request to multiple personal mobile terminals 200 simultaneously by using the first Bluetooth signal 113. Each personal mobile terminal 200 feeds a response such as passenger identity information back to the first Bluetooth module 130 only when the request is received. Time for sending the request by the first Bluetooth module 130 can be set selectively. For example, the first Bluetooth module 130 sends requests before the car door 113 is open and after the car door 113 is closed respectively in a stopping process of the elevator car 110. For example, after the car door 113 of the elevator car 110 is closed and the elevator car 110 is ready to depart, the first Bluetooth module 130 broadcasts a request, and each personal mobile terminal 200 feeds back passenger identity information, so that the first Bluetooth module 130 can generate a passenger information list of passengers inside the elevator car 110.

In an embodiment, the first Bluetooth module 130 specifically can be a Bluetooth Low Energy (BLE) module, and the first Bluetooth signal 131 broadcasted by the first Bluetooth module 130 is correspondingly a BLE signal. The personal mobile terminal 200 is correspondingly a terminal adaptive to BLE communication. For example, the personal mobile terminal 200 can be implemented by using a smart phone, a wearable intelligent device, a personal digital assistant (PAD), and the like. As such, a Bluetooth communication interaction manner between the first Bluetooth module 130 and the personal mobile terminal 200 consumes low energy.

For ease of description, FIG. 1 shows three passengers 90-1, 90-2 and 90-3, and they carry personal mobile terminals 200-1, 200-2 and 200-3 respectively. The dashed line arrow shown in FIG. 1 represents a passenger movement direction when the elevator car 110 stops at a floor N. For example, it is assumed that the passenger 90-1 leaves the elevator car 110, the passenger 90-2 enters the elevator car 110 from an elevator landing area of the floor N, and the passenger 90-3 basically keeps staying in the elevator car 110.

Further referring to FIG. 1, the passenger flow tracking system further includes a passenger flow determining unit 510 connected with the first Bluetooth module 130 of each elevator car 110. The response received by the first Bluetooth module 130 can be sent to the passenger flow determining unit 510. The passenger flow determining unit 510 determines a passenger flow condition corresponding to the elevator car 110 based on the response or a change in the response.

In an embodiment, as shown in FIG. 1, taking the passenger 90-1 as an example, the passenger flow determining unit 510 can determine, based on a change in the response corresponding to the passenger 90-1, the passenger 90-1 who leaves the elevator car 110. During judgment of the change in the response, for example, when the elevator car 110 stops at a floor N, the car door 113 is open (a landing door is definitely open as well), and the passenger 90-1 moves from the elevator car 110 to the elevator landing area (such as a hall) of the floor N. Correspondingly, the response received by the first Bluetooth module 130 from the personal mobile terminal 200-1 will also change. For example, the situation where the first Bluetooth module 130 receives the passenger identifier information of the passenger 90-1 corresponding to the personal mobile terminal 200-1 changes into a situation where the first Bluetooth module does not receive the passenger identifier information of the passenger 90-1 corresponding to the personal mobile terminal 200-1. In this case, the passenger flow determining unit 510 can determine, based on the change in the response, the passenger 90-1 who leaves the elevator car 110.

In another embodiment, taking the passenger 90-2 as an example, the passenger flow determining unit 510 can determine, based on a change in the response corresponding to the passenger 90-2, the passenger 90-2 who enters the elevator car 110. During judgment of the change in the response, for example, when the elevator car 110 stops at a floor N, the car door 113 is open (a landing door is definitely open as well), and the passenger 90-2 moves from the elevator landing area (such as a hall) of the floor N to the elevator car 110. Correspondingly, the response received by the first Bluetooth module 130 from the personal mobile terminal 200-2 will also change. For example, when the situation where the first Bluetooth module 130 does not receive the passenger identifier information of the passenger 90-2 corresponding to the personal mobile terminal 200-2 changes into a situation where the first Bluetooth module 130 receives the passenger identifier information of the passenger 90-2 corresponding to the personal mobile terminal 200-2. In this case, the passenger flow determining unit 510 can determine, based on the change in the response, the passenger 90-2 who enters the In still another embodiment, taking the passenger 90-3 as an example, the passenger flow determining unit 510 can determine, based on the response corresponding to the passenger 90-3, the passenger 90-3 who stays in the elevator car 110. For example, when the elevator car 110 stops at a floor N, the car door 113 is open (a landing door is definitely open as well), the passenger 90-3 keeps staying in the elevator car 110. Correspondingly, the response received by the first Bluetooth module 130 from the personal mobile terminal 200-3 will also stay basically unchanged. For example, the first Bluetooth module 130 keeps receiving the passenger identifier information of the passenger 90-3 corresponding to the personal mobile terminal 200-3. In this case, the passenger flow determining unit 510 can determine the passenger 90-3 inside the elevator car 110 based on the foregoing response.

In an embodiment, when the car door 113 of the elevator car 110 is closed, based on the passenger identifier information received by the first Bluetooth module 130, the passenger flow determining unit 510 can determine a passenger list of passengers 90 inside the elevator car 110. For example, the passenger list includes passenger identifier information corresponding to the passenger 90-2 and the passenger 90-3.

The response fed back by the personal mobile terminal 200 can include information of a current floor where the personal mobile terminal 200 is located, and the floor information can be received from the first Bluetooth signal 131.

Based on the foregoing example, the passenger flow determining unit 510 can determine flow of each passenger among multiple passengers 90 with respect to the elevator car 110, so that a passenger flow condition in the elevator car 110 at each stop floor can be tracked seamlessly, for example, the number of passengers entering the elevator car 110 and the number of passengers leaving the elevator car 100. Particularly, it can be determined which passengers 90 leave the elevator car 110 at which floor, and which passengers 90 enter the elevator car 110 at which floor, and it can be determined which passengers 90 take the elevator after the car door 113 is closed.

Figure 2:
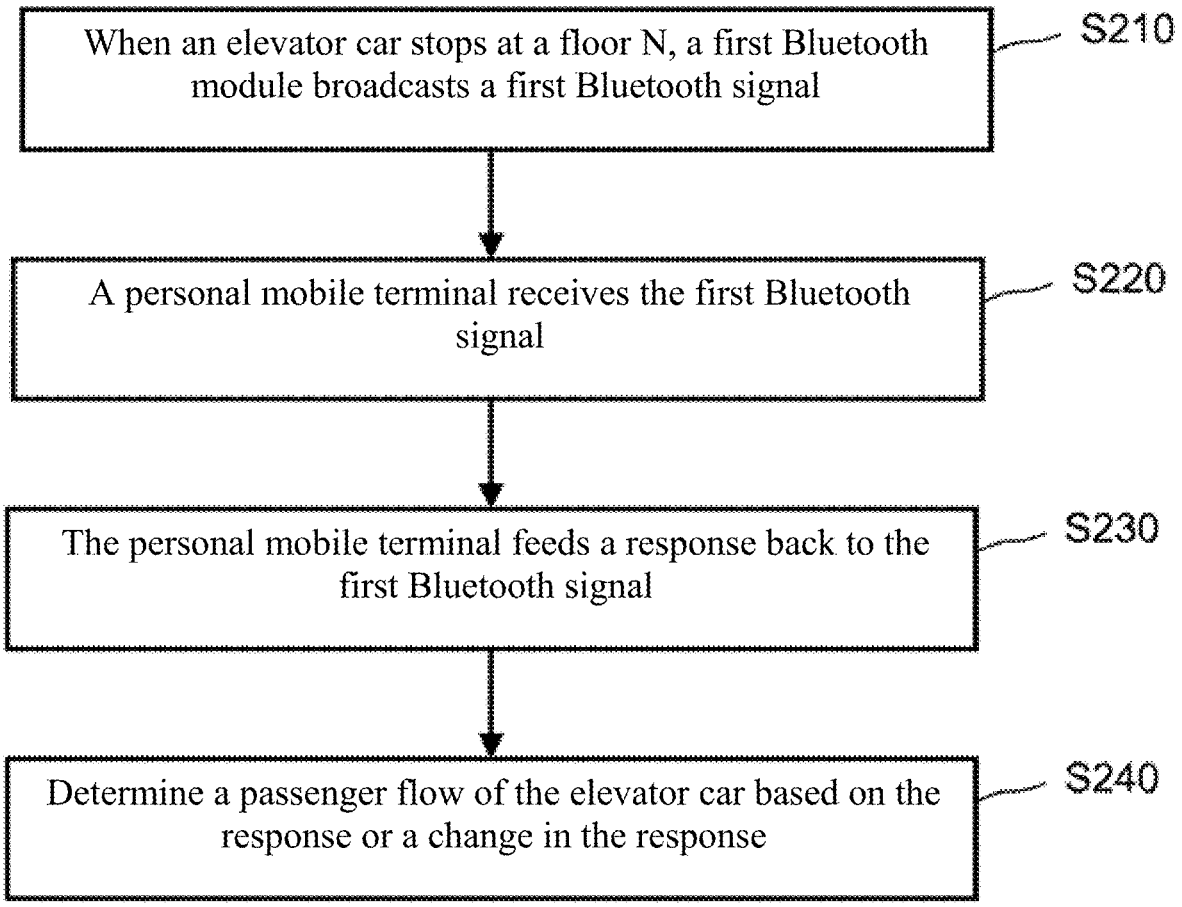
FIG. 2 is a schematic flowchart of a passenger flow tracking method for an elevator car according to an embodiment of the present invention.

FIG. 2 is a schematic flowchart of a passenger flow tracking method for an elevator car according to an embodiment of the present invention. The passenger flow tracking method applied in the passenger flow tracking system shown in FIG. 1 is described with reference to FIG. 1 and FIG. 2.

First of all, as shown in FIG. 2, in step S210, a first Bluetooth module 130 broadcasts a first Bluetooth signal 131 when an elevator car 110 stops at a floor N. In another embodiment, the first Bluetooth module 130 can also broadcast the first Bluetooth signal 131 out of a stopping time of the elevator car 110. The broadcasted first Bluetooth signal 131 can substantially cover the interior of the elevator car 110. The broadcasted first Bluetooth signal 131 can also include floor information, such as the $N^{th}$ floor or landing N.

Further, in step S220, a personal mobile terminal 200 receives the first Bluetooth signal 131. For example, before a car door 113 is open, personal mobile terminals 200 (such as personal mobile terminals 200-1, 200-2 and 200-3) of all passengers 90 (such as passengers 90-1, 90-2 and 90-3) in the elevator car 110 can receive the first Bluetooth signal 131. After the car door 113 is open, the personal mobile terminal 200 (such as the personal mobile terminal 200-2) of the passenger 90 (such as the passenger 90-2) entering the elevator car 110 can also receive the first Bluetooth signal 131. The personal mobile terminal 200 (such as the personal mobile terminal 200-1) of the passenger 90 (such as the passenger 90-1) who has left the elevator 110 (for example, 0.5-2 meters away from the car door of the elevator car 110) does not receive the first Bluetooth signal 131.

Further, in step S230, the personal mobile terminal 200 feeds a response back to the first Bluetooth module 130. Before the car door 113 is open, the personal mobile terminals 200 (such as the personal mobile terminals 200-1, 200-2 and 200-3) of all the passengers 90 (such as the passengers 90-1, 90-2 and 90-3) in the elevator car 110 can feed back respective passenger identifier information. After the car door 113 is open, the personal mobile terminal 200 (such as the personal mobile terminal 200-2) of the passenger 90 (such as the passenger 90-2) entering the elevator car 110 also starts to be able to feed back the passenger identifier information thereof. The personal mobile terminal 200 (such as the personal mobile terminal 200-1) of the passenger 90 (such as the passenger 90-1) who has left the elevator car 110 (for example, 0.5-2 meters away from the car door of the elevator car 110) stops feeding back the passenger identifier information thereof. These responses can be received by the first Bluetooth module 130 and can be sensed by a passenger flow determining unit 510.

In other embodiments, the response fed back by the first Bluetooth module 130 can further include one or more pieces of the following information: signal strength of the first Bluetooth signal 131 received by the personal mobile terminal 200, position information obtained through positioning with respect to the elevator car 110, destination floor information of the passenger 90, and so on.

Further, in step S240, a passenger flow with respect to the elevator car is determined based on the response or a change in the response. This step is completed in the passenger flow determining unit 510.

In an embodiment, the passenger flow determining unit 510 can determine, according to a change of the passenger identifier information received before the car door is open with respect to the passenger identifier information received after the car door is open (for example, when the car door 113 is closed), the passenger 90-1 who leaves the elevator car 110, the passenger 90-2 who enters the elevator car 110, and the passenger 90-3 who keeps staying in the elevator car 110. Further, in this step, a first passenger list of passengers who leave the elevator car 110 at a floor N and a second passenger list of passengers who enter the elevator car 110 at a floor N can also be generated. Moreover, when the car door 113 of the elevator car 110 is closed, a third passenger list of passengers inside the elevator car 110, that is, a passenger list of passengers who take the elevator, can be generated based on the passenger identifier information received by the first Bluetooth module 130.

When the response fed back by the first Bluetooth module 130 includes signal strength information of the first Bluetooth signal 131 received by the personal mobile terminal 200, the first Bluetooth module 130 can roughly determine movement of the passenger 90 with respect to the elevator car 110 based on a change in the signal strength. For example, when the signal strength is greater than a predetermined value at first and then becomes less than the predetermined value, it is determined that the passenger 90 leaves the elevator car 110. When the signal strength is less than the predetermined value at first and then becomes greater than the predetermined value, it is determined that the passenger enters the elevator car 110.

When the response fed back by the first Bluetooth module 130 includes position information obtained through positioning with respect to the elevator car 110, the first Bluetooth module 130 can roughly determine, based on a change in the position information, whether the passenger 90 enters the elevator car 110 or leaves the elevator car 110. It should be noted that, when the response is passenger identifier information, the passenger identifier information can be pre-stored in the personal mobile terminal 200 and can also be obtained easily. Moreover, it is also fast to feed back and send the passenger identifier information. The first Bluetooth module 130 can easily obtain, within a relatively short time, passenger identifier information fed back by a relatively large number of personal mobile terminals 200. The tracking of the passenger flow will become fast, efficient, and accurate.

The result about the passenger flow information of the elevator car determined above (such as the foregoing first passenger list, second passenger list, and third passenger list) can be sent to an elevator controller. In the elevator system in the following embodiment shown in FIG. 3 of the present invention, running of one or more elevator cars 110 can be controlled based on the foregoing passenger list information.

Figure 3:
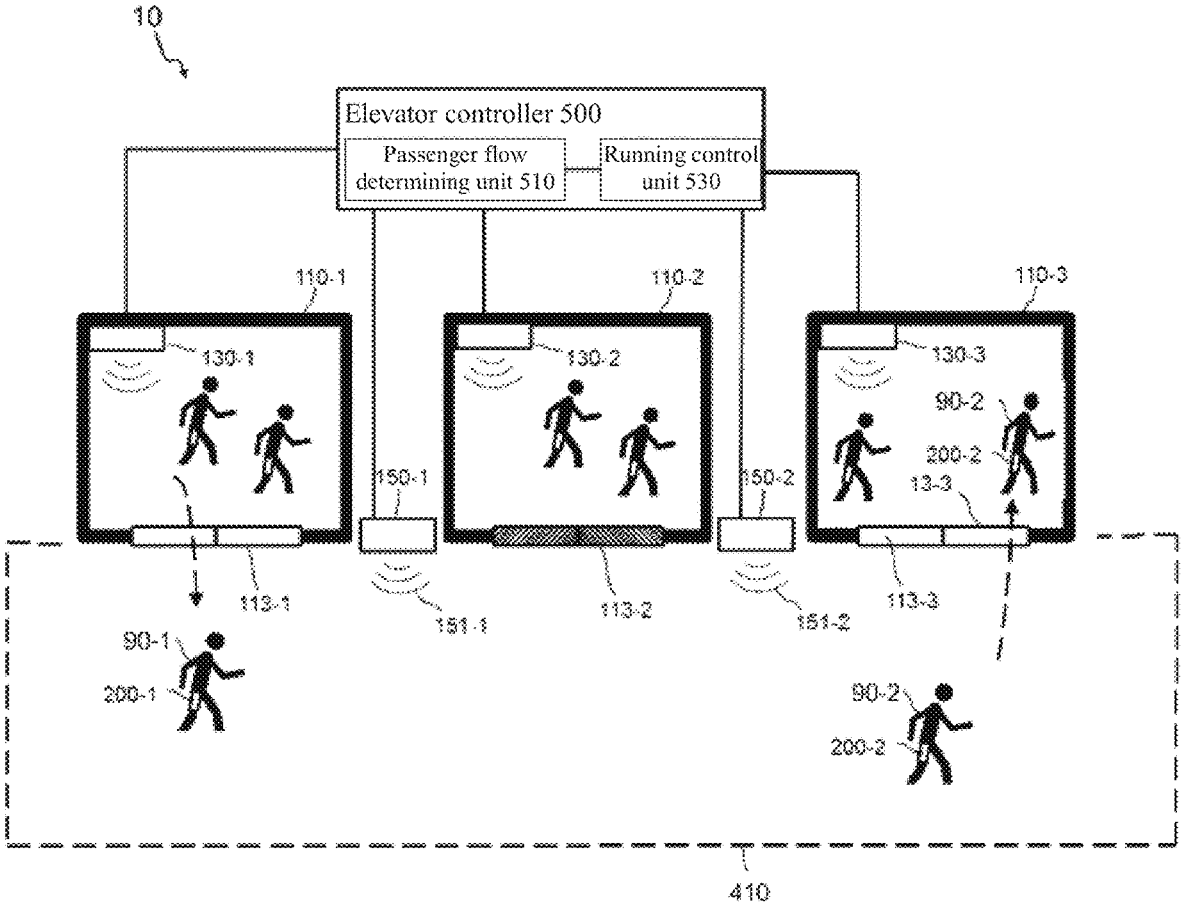
FIG. 3 is a schematic structural diagram of an elevator system according to an embodiment of the present invention.

FIG. 3 is a schematic structural diagram of an elevator system according to an embodiment of the present invention. FIG. 3 schematically shows three elevator cars 110-1, 110-2 and 110-3 in an elevator system 10, which all stop, for example, at a floor N. Regions outside the elevator cars 110-1, 110-2 and 110-3 are correspondingly an elevator landing area 410 of the floor N, such as a hall. Running of the elevator cars 110-1, 110-2 and 110-3 can be controlled by using an elevator controller 500 of the elevator system 10, specifically by using a running control unit 530 for example.

It will be understood that it is meaningful to control running of the elevator car 110 by applying the passenger flow tracking system in the embodiment shown in FIG. 1 to the elevator system 10 in the embodiment shown in FIG. 3, especially applied to an elevator system that can implement an elevator calling operation automatically without requiring an input operation of a passenger.

As shown in FIG. 3, the elevator system 10 includes one or more second Bluetooth modules 150 installed in each elevator landing area 410, for example, second Bluetooth modules 150-1 and 150-2. The second Bluetooth modules 150 can implement Bluetooth interaction with personal mobile terminals 200 carried by passengers 90, thus achieving an automatic elevator calling operation function. The second Bluetooth module 150 can emit or broadcast a second wireless signal 151 continuously. For example, the second Bluetooth modules 150-1 and 150-2 broadcast second Bluetooth signals 151-1 and 151-2 respectively. When the personal mobile terminal 200 approaches the second Bluetooth module 150 or once the personal mobile terminal 200 enters the elevator landing area 410, the personal mobile terminal 200 can establish a Bluetooth connection with one of the second Bluetooth modules 150 automatically, so that the personal mobile terminal 200 can automatically send an elevator calling request command to the second Bluetooth module 150. The second Bluetooth module 150 receives the elevator calling request command and automatically sends the elevator calling request command to the elevator controller 500 connected to the second Bluetooth module 150. In an example, a distance from the personal mobile terminal 200 to the second Bluetooth module 150 can be determined according to signal strength of the second Bluetooth signal received by the personal mobile terminal 200. When the distance is less than or equal to a predetermined distance threshold, the personal mobile terminal 200 establishes a Bluetooth connection with the second Bluetooth module 150 automatically.

Specifically, the elevator calling request command can be an elevator calling request command including an elevator calling direction and a destination floor. The second Bluetooth module 150 can establish a connection with the elevator controller of the elevator system and send the elevator calling request command to the elevator controller 500 automatically. The elevator controller 500 is configured to control running of multiple elevator cars 110 in the elevator system, for example, perform scheduling control based on the elevator calling request command, and designate one of the multiple elevator cars 110 to stop at a landing where the passenger 90 is located and carry the passenger 90 to a corresponding destination floor. The designated elevator car 110 is also pre-registered in the destination floor of the passenger 90. For example, the destination floor is automatically registered on a floor registration control panel. As such, the passenger 90 can implement a completely automatic elevator calling operation and can implement a hand-free or input-free elevator calling operation.

However, in the elevator system 10 in the foregoing embodiment, the personal mobile terminal 200 of a passenger 90 walking out from any elevator car 110 will establish a Bluetooth connection with the second Bluetooth module 150 in the elevator landing area 410 and automatically send an elevator calling request command. In most cases, a passenger 90 leaving the elevator car 110 does not need to take the elevator again. In other words, the elevator calling request command sent automatically at this time cannot authentically reflect an elevator riding intention of the passenger 90.

To this end, the elevator controller 500 is configured to receive passenger flow information of the passenger flow determining unit 510 of each elevator car 110. In an embodiment, the passenger flow determining unit 510 can be implemented by using the elevator controller 500 or disposed in the elevator controller 500. The passenger flow determining unit 510 can establish a communication connection with the first Bluetooth module 130 installed in each elevator car 110.

Based on the description about the foregoing passenger flow tracking system in the embodiment shown in FIG. 1, the passenger flow determining unit 510 at least can determine a passenger 90 leaving the elevator car 100. The passenger flow determining unit 510 sends, to the running control unit 530 of the elevator controller 500, the determined passenger 90 leaving the elevator car 100 (for example, a first passenger list of passengers leaving the elevator car 110 at the floor N). Based on the first passenger list, the running control unit 530 will ignore elevator calling request commands that are automatically sent by the personal mobile terminals 200 of all the passengers in the first passenger list to the elevator controller 500 through the second Bluetooth module 150 in the elevator landing area 410. As such, the elevator calling request command that is automatically sent by the personal mobile terminal 200 of the passenger 90 when the passenger 90 leaves the elevator car 110 and enters the elevator landing area 410 of the floor N will be considered as an invalid elevator calling request by the running control unit 530. In an embodiment, the running control unit 530 can resume receiving the elevator calling request command of the personal mobile terminal 200 corresponding to the passenger 90 at the floor N after a predetermined time since the moment when the passenger 90 leaves the elevator car 110 (for example, since the moment when the running control unit 530 stops receiving the passenger identifier information of the passenger 90 from the first Bluetooth module 130), and control and schedule the elevator car based on the command, thus recovering an automatic elevator calling operation function of the passenger 90 at the floor N.

Taking the elevator car 110-1 as an example, as shown in FIG. 3, the elevator car 110-1 stops at the floor N and the car door 113-1 is open, the passenger 90-1 leaves the elevator car 110-1 for the elevator landing area 410 of the floor N. In this case, the personal mobile terminal 200-1 of the passenger 90-1 will receive the second Bluetooth signal 151-1 broadcasted by the second Bluetooth module 150-1 in the elevator landing area 410 and interact with the second Bluetooth module 150-1 to establish a Bluetooth connection. As such, the personal mobile terminal 200-1 automatically sends the elevator calling request command to the elevator controller 500 through the second Bluetooth module 150-1. Meanwhile, the case that the passenger 90-1 leaves the elevator car 110-1 is also determined by the passenger flow determining unit 510, and the passenger identifier information of the passenger 90-1 is also included in the first passenger list. As such, the running control unit 530 will compare the first passenger list with a passenger list corresponding to the received elevator calling request commands and ignore the elevator calling request commands of the same passenger (such as the passenger 90-1) in the two lists. As such, no elevator car is scheduled or arranged for the elevator calling request command of the passenger 90-1, thus helping improve the running efficiency of the elevator system 10.

In another embodiment, based on the description about the foregoing passenger flow tracking system in the embodiment shown in FIG. 1, the passenger flow determining unit 510 sends a determined passenger list of passengers inside the elevator car 110 (for example, a third passenger list of passengers in the elevator car 110-2 at the floor N after the car door 113-2 of the elevator car 110-2 is closed) to the running control unit 530 of the elevator controller 500. The running control unit 530 will control running of the elevator car 110-2 based on the third passenger list.

Taking the elevator car 110-2 as an example, as shown in FIG. 3, when the elevator car 110-2 stops at the floor N, the car door 113-2 is closed, and the elevator car 110-2 is ready to depart, all passengers 90 in the elevator car 110-2 can be determined, and the passenger identifier information of the passengers 90 is included in the third passenger list. Meanwhile, the running control unit 530 will generate, based on the automatically generated elevator calling request commands, a passenger list of passengers that need to be carried from the floor N, the passenger list being assigned to the elevator car 110-2. As such, the running control unit 530 will compare the third passenger list with the passenger list of passengers needing to be carried from the floor N corresponding to the elevator car 110-2. If a passenger in the passenger list of passengers needing to be carried from the floor N corresponding to the elevator car 110-2 does not exist in the third passenger list, the passenger probably fails to enter the designated elevator car 110-2 (for example, the elevator car 110-2 is overcrowded and the passenger changes mind temporarily), scheduling arrangement corresponding to the elevator calling request command of the passenger will be canceled. For example, destination floor information registered by the passenger in the elevator car 110-2 (if no other passenger registers this destination floor information) is canceled. As such, no elevator car is scheduled or arranged for the passenger 90 who fails to enter the designated elevator car 110-2, thus helping improve the running efficiency of the elevator system 10.

In still another embodiment, based on the description about the foregoing passenger flow tracking system in the embodiment shown in FIG. 1, the passenger flow determining unit 510 can determine the passenger 90 entering the elevator car 100. The passenger flow determining unit 510 sends, to the running control unit 530 of the elevator controller 500, the determined passenger 90 entering the elevator car 100 (for example, the third passenger list of passengers leaving the elevator car 110 at the floor N).

Taking the elevator car 110-3 as an example, as shown in FIG. 3, when the elevator car 110-3 stops at the floor N and before the car door 113-3 is open, the personal mobile terminal 200-2 of the passenger 90-2 receives the second Bluetooth signal 151-2, meanwhile establishes a Bluetooth connection with the second Bluetooth module 150-2, and automatically sends the elevator calling request command. After the car door 113-3 is open, the passenger 90-2 enters the elevator car 110-3 from the elevator landing area 410 of the floor N. Meanwhile, the case that the passenger 90-2 enters the elevator car 110-3 is also determined by the passenger flow determining unit 510, and the passenger identifier information of the passenger 90-2 is included in the second passenger list. As such, the elevator controller 500 can precisely know which passengers successfully enter the corresponding elevator car at the floor N.

The elevator system 10 in the foregoing embodiment can generate passenger flow information due to the application of the passenger flow tracking system, so that the elevator system 10 can determine valid elevator calling request commands more accurately during scheduling arrangement, thus greatly improving the running efficiency of the elevator system.

It will be understood that, the passenger flow tracking system in the foregoing embodiment of the present invention is not limited to being applied in the elevator system 10 in the foregoing embodiment, and can also be applied in elevator systems with an automatic elevator calling function in other embodiments. For example, the second Bluetooth module 150 is replaced with a wireless node that broadcasts or emits other wireless signals and can wirelessly interact with the personal mobile terminal 220. The elevator calling request command sent by the second Bluetooth module 150 can only include an elevator calling direction, etc.

It will be appreciated by those skilled in the art that aspects of the present invention can be embodied as a system, a method or a computer program product. Therefore, the aspects of the present invention can employ the following forms: a full hardware implementation solution, a full software implementation solution (including firmware, resident software, microcode, and the like), or an implementation solution combining software and hardware aspects, which can be generally all referred to as "service", "circuit", "circuit system", "module" and/or "processing system". In addition, the aspects of the present invention can employ a form of a computer program product in one or more computer readable media on which computer readable program codes are implemented.

One computer readable medium or any combination of multiple computer readable media can be used. The computer readable medium can be a computer readable signal medium or a computer readable storage medium. The computer readable storage medium can be for example, but is not limited to, an electronic, magnetic, electromagnetic, infrared, or semiconductor system, device or apparatus, or any suitable combination of the foregoing items. More specific examples (not an exhaustive list) of the computer readable storage medium will include the following items: an electric connection having one or more wires, a portable computer magnetic disk, a hard disk, a random access memory (RAM), a read-only memory (ROM), an erasable programmable read-only memory (EPROM or flash memory), an optical fiber, a compact disc read-only memory (CD-ROM), an optical storage apparatus, a magnetic storage apparatus, or any suitable combination of the foregoing items. In the context of this document, the computer readable storage medium can be any physical medium that can contain or store instructions used by an instruction execution system, device or apparatus or that is used in combination with the instruction execution system, device or apparatus.

The program codes and/or executable instructions embodied on the computer readable medium can be transmitted by using any suitable medium, which includes, but is not limited to: wireless, wired, fiber cable, RF, and so on, or any suitable combination of the foregoing items.

Computer program codes for implementing operations of the aspects of the present invention can be written by using one programming language or any combination of multiple programming languages, including object-oriented programming languages such as Java, Smalltalk, and C++, and conventional programming languages such as "C" programming language or similar programming languages. The program codes can be completely executed on a computer (apparatus) of a user, partially executed on the computer of the user, executed as an independent software package, partially executed on the computer of the user and partially executed on a remote computer, or completely executed on the remote computer or server. In the latter case, the remote computer can be connected to the computer of the user through any type of network including a local area network (LAN) or a wide area network (WAN), or can be connected to an external computer (for example, connected through the Internet by using an Internet service provider).

The computer program instructions can be provided to a processor of a general-purpose computer, a processor of a special-purpose computer such as an image processor, or another programmable data processing device to generate a machine, so that instructions executed by the processor of the computer or another programmable data processing device create a manner for implementing functions/actions specified in one or more blocks in a flowchart and/or block diagram.

The computer program instructions can also be loaded to a computer, another programmable data processing device or another apparatus, so that a series of operation steps are executed on the computer, another programmable device or another apparatus to generate a computer-implemented process. Thus, the instructions executed on the computer or another programmable device provide the process for implementing the functions and actions specified in this text.

It should be further noted that in some alternative implementations, the functions/operations shown in the blocks can occur without following the order shown in the flowchart. For example, two blocks shown successively can be executed substantially simultaneously or the blocks can be executed in a reverse order in some cases, which specifically depends on the functions/operations involved. Although the particular step sequence is shown, disclosed and required, it should be understood that the steps can be implemented, separated or combined in any order, and will still benefit from the present disclosure unless otherwise specified.

The specification uses embodiments to disclose the present invention, including the optimal mode, and also enables any person skilled in the art to practice the present invention, including fabricating and using any apparatus or system and executing any covered method. The patent protection scope of the present invention is defined by the claims, and can include other embodiments that can be conceived of by those skilled in the art. If such other embodiments have structural elements that are the same as the literal expression of the claims or have equivalent structural elements that are not substantially different from the literal expression of the claims, such embodiments are intended to fall in the scope of the claims.

What is claimed is:

1. A passenger flow tracking system for an elevator car, comprising:

a first Bluetooth module installed in the elevator car, the first Bluetooth module being configured to broadcast a first Bluetooth signal that can substantially cover the interior of the elevator car and receive a response as a received response fed back by a personal mobile terminal carried by a passenger inside the elevator car;

one or more personal mobile terminals, each of the one or more personal mobile terminals carried by each of one or more passengers, each of the one or more personal mobile terminals configured to receive the first Bluetooth signal as a received first Bluetooth signal and feed the response back to the first Bluetooth module based on the first Bluetooth signal; and a passenger flow determining unit configured to determine, based on a change in the received response, that the passenger leaves and/or enters the elevator car;

wherein the personal mobile terminal is configured to determine signal strength of the received first Bluetooth signal, and feed the response back to the first Bluetooth module only when the signal strength of the received first Bluetooth signal is greater than or equal to a predetermined value; wherein the response comprises signal strength of the first Bluetooth signal received by the personal mobile terminal.

2. The system according to claim 1, wherein the first Bluetooth signal comprises a request sent by the first Bluetooth module; and the personal mobile terminal is configured to feed the response back to the first Bluetooth module only when the request is received.

3. The system according to claim 1, wherein the response comprises passenger identifier information, and the passenger identifier information corresponds to a respective one of the one or more passengers carrying the one or more personal mobile terminals.

4. The system according to claim 3, wherein the passenger flow determining unit is further configured to: when a situation where the first Bluetooth module receives passenger identifier information of the passenger corresponding to the personal mobile terminal changes into a situation where the first Bluetooth module does not receive the passenger identifier information of the passenger corresponding to the personal mobile terminal, determine that the passenger corresponding to the passenger identifier information leaves the elevator car.

5. The system according to claim 3, wherein the passenger flow determining unit is further configured to: when a situation where the first Bluetooth module does not receive passenger identifier information of the passenger corresponding to the personal mobile terminal changes into a situation where the first Bluetooth module receives the passenger identifier information of the passenger corresponding to the personal mobile terminal, determine that the passenger corresponding to the passenger identifier information enters the elevator car.

6. The system according to claim 3, wherein the passenger flow determining unit is further configured to determine a passenger inside the elevator car based on received passenger identifier information.

7. The system according to claim 6, wherein the passenger flow determining unit is further configured to: after a car door of the elevator car is closed and the elevator car is ready to depart, determine a first passenger list of passengers inside the elevator car corresponding to a current floor based on the passenger identifier information received by the first Bluetooth module.

8. The system according to claim 1, wherein the response comprises one or more pieces of the following information: signal strength of the first Bluetooth signal received by the personal mobile terminal, position information obtained through positioning with respect to the elevator car, and destination floor information of the passenger.

9. The system according to claim 1, wherein the first Bluetooth module is a Bluetooth Low Energy (BLE) module.

10. A passenger flow tracking method for an elevator car, comprising:

broadcasting, by a first Bluetooth module installed in the elevator car, a first Bluetooth signal that can substantially cover the interior of the elevator car;

receiving, by a personal mobile terminal carried by a passenger inside the elevator car, the first Bluetooth signal and feeding a response back to the first Bluetooth module; and determining, based on a change in the response, that the passenger leaves and/or enters the elevator car;

wherein the feeding the response back includes determining, by the personal mobile terminal, a signal strength of the received first Bluetooth signal and feeding the response back to the first Bluetooth module only when the signal strength of the received first Bluetooth signal is greater than or equal to a predetermined value.

11. The passenger flow tracking method according to claim 10, wherein in the feedback step, the first Bluetooth module sends a request by using the first Bluetooth signal, and the personal mobile terminal feeds the response back to the first Bluetooth module only when the request is received.

12. The passenger flow tracking method according to claim 10, wherein the response comprises passenger identifier information, and the passenger identifier information corresponds to a respective one of the one or more passengers carrying the one or more personal mobile terminals.

13. The passenger flow tracking method according to claim 12, wherein in the step of determining that the passenger leaves the elevator car, when a situation where the first Bluetooth module receives passenger identifier information of the passenger corresponding to the personal mobile terminal changes into a situation where the first Bluetooth module does not receive the passenger identifier information of the passenger corresponding to the personal mobile terminal, it is determined that the passenger corresponding to the passenger identifier information leaves the elevator car.

14. The passenger flow tracking method according to claim 12, wherein in the step of determining that the passenger enters the elevator car, when a situation where the first Bluetooth module does not receive passenger identifier information of the passenger corresponding to the personal mobile terminal changes into a situation where the first Bluetooth module receives the passenger identifier information of the passenger corresponding to the personal mobile terminal, it is determined that the passenger corresponding to the passenger identifier information enters the elevator car.

15. The passenger flow tracking method according to claim 12, further comprising a step of determining a passenger inside the elevator car based on the passenger identifier information.

16. The passenger flow tracking method according to claim 15, wherein in the step of determining a passenger inside the elevator car, after a car door of the elevator car is closed and the elevator car is ready to depart, a first passenger list of passengers inside the elevator car corresponding to a current floor is determined based on the passenger identifier information received by the first Bluetooth module.

17. The passenger flow tracking method according to claim 10, wherein in the step of determining that the passenger leaves the elevator car, a passenger list of passengers leaving the elevator car corresponding to a landing is further generated.

18. The passenger flow tracking method according to claim 10, wherein the response comprises one or more pieces of the following information: signal strength of the first Bluetooth signal received by the personal mobile terminal, position information obtained through positioning with respect to the elevator car, and destination floor information of the passenger.

19. The passenger flow tracking method according to claim 10, wherein the first Bluetooth module is a Bluetooth Low Energy (BLE) module, and the first Bluetooth signal is a BLE signal.

20. An elevator system, comprising one or more elevator cars and an elevator controller configured to control running of the one or more elevator cars, and further comprising:

the passenger flow tracking system according to claim 1.

21. The elevator system according to claim 20, further comprising a second Bluetooth module installed in an elevator landing area and configured to broadcast a second Bluetooth signal, wherein when a passenger approaches the second Bluetooth module, the personal mobile terminal corresponding to the passenger receives the second Bluetooth signal and interacts with the second Bluetooth module based on the second Bluetooth signal, so as to automatically send an elevator calling request command to the elevator controller via the second Bluetooth module.

22. The elevator system according to claim 21, wherein the elevator controller is configured to: based on a passenger who leaves the elevator car and corresponds to an elevator landing area as determined by the passenger flow tracking system, ignore an elevator calling request command that is automatically sent by the personal mobile terminal of the passenger as the passenger leaves the elevator car for the elevator landing area.

23. The elevator system according to claim 22, wherein the elevator controller is configured to receive a first passenger list, which is determined in the passenger flow tracking system, of passengers inside the elevator car, and control running of the elevator car based on elevator calling request commands of the passengers corresponding to the first passenger list.

24. The elevator system according to claim 23, wherein the elevator controller is further configured to generate, based on the elevator calling request commands, a second passenger list of to-be-carried passengers assigned to the elevator car, compare the first passenger list with the second passenger list, and if a passenger in the second passenger list does not exist in the first passenger list, cancel scheduling arrangement corresponding to an elevator calling request command of the passenger.

25. A control method for the elevator system according to claim 20, wherein based on a passenger who leaves the elevator car and corresponds to an elevator landing area as determined by the passenger flow tracking system, an elevator calling request command that is automatically sent by a personal mobile terminal of the passenger as the passenger leaves the elevator car for the elevator landing area is ignored.

26. The control method according to claim 25, further comprising steps of:

after a car door of the elevator car is closed and the elevator car is ready to depart, determining a first passenger list of passengers inside the elevator car corresponding to a current floor based on passenger identifier information received by the first Bluetooth module; and controlling running of the elevator car based on elevator calling request commands of the passengers corresponding to the first passenger list.

27. The control method according to claim 26, wherein in the step of controlling running of the elevator car based on elevator calling request commands of the passengers corresponding to the first passenger list, a second passenger list of to-be-carried passengers assigned to the elevator car is generated based on the elevator calling request commands, the first passenger list is compared with the second passenger list, and if a passenger in the second passenger list does not exist in the first passenger list, scheduling arrangement corresponding to an elevator calling request command of the passenger is cancelled.

* * * * *